US010952589B2

(12) United States Patent
Brightbill et al.

(10) Patent No.: US 10,952,589 B2
(45) Date of Patent: Mar. 23, 2021

(54) DISHWASHER WITH HYDRAULICALLY POWERED WASH SYSTEM

(71) Applicant: Whirlpool Corporation, Benton Harbor, MI (US)

(72) Inventors: David Jason Brightbill, Benton Harbor, MI (US); Frederick Thomas Roderick, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 303 days.

(21) Appl. No.: 15/850,966

(22) Filed: Dec. 21, 2017

(65) Prior Publication Data

US 2019/0191959 A1 Jun. 27, 2019

(51) Int. Cl.

| | |
|---|---|
| ***A47L 15/22*** | (2006.01) |
| ***A47L 15/42*** | (2006.01) |
| *B08B 3/02* | (2006.01) |

(52) U.S. Cl.

CPC ..... *A47L 15/22* (2013.01); *A47L 15/4221* (2013.01); *A47L 15/4278* (2013.01); *A47L 15/4225* (2013.01); *B08B 3/02* (2013.01)

(58) Field of Classification Search

CPC .... A47L 15/4278; A47L 15/22; A47L 15/508; A47L 15/4221; A47L 15/4225; A47L 15/4282; B08B 3/02

See application file for complete search history.

(56) References Cited

U.S. PATENT DOCUMENTS

| | | | | |
|---|---|---|---|---|
| 3,323,529 | A * | 6/1967 | Geiger | A47L 15/23 134/104.1 |
| 3,599,872 | A * | 8/1971 | Guth | A47L 15/23 239/261 |
| 3,866,837 | A * | 2/1975 | Jenkins | A47L 15/23 239/261 |
| 4,174,723 | A * | 11/1979 | Long | A47L 15/23 134/144 |
| 4,257,559 | A * | 3/1981 | Noren | A47L 15/16 239/283 |
| 5,673,716 | A | 10/1997 | Gurubatham et al. | |
| 5,927,616 | A * | 7/1999 | Grise | A47L 15/4278 134/201 |
| 7,931,034 | B2 * | 4/2011 | Mack | A47L 15/23 134/176 |
| 2012/0138106 | A1 | 6/2012 | Fountain et al. | |

* cited by examiner

*Primary Examiner* — Benjamin L Osterhout
(74) *Attorney, Agent, or Firm* — McGarry Bair PC

(57) ABSTRACT

A dishwasher for treating dishes according to a cycle of operation includes a tub at least partially defining a treating chamber, a manifold, a rotatable sprayer that is rotatable about a rotation axis and has an inlet and multiple nozzles collectively forming an outlet and a bushing creating a sealing interface between the manifold and the rotatable sprayer.

20 Claims, 7 Drawing Sheets

DISHWASHER WITH HYDRAULICALLY POWERED WASH SYSTEM

BACKGROUND

Contemporary automatic dishwashers for use in a typical household include a tub and at least one rack or basket for supporting soiled dishes within the tub. At least an upper rack and a lower rack for holding dishes to be cleaned are typically provided within the treating chamber. A silverware basket for holding utensils, silverware, etc. is also usually provided and normally removably mounts to the door or within the lower rack.

A spraying system can be provided for recirculating liquid throughout the tub to remove soils from the dishes. The spraying system can include various sprayers, including one or more rotatable tube wash systems. Powering and driving the rotation in a tube wash manifold can be a significant contributor to the cost and complexity of the wash system within a dishwasher.

BRIEF DESCRIPTION

An aspect of the present disclosure relates to a dishwasher for treating dishes according to a cycle of operation, the dishwasher comprising a tub at least partially defining a treating chamber, a manifold operably coupled to the tub and having a manifold body forming a fluid passage, a sprayer having a body, a portion of which is rotatably housed within the manifold, the body defining an inlet, multiple nozzles collectively forming an outlet, and rotatable about an axis of rotation, and a bushing including a flange section defining a first end and a barrel section at least a portion of which includes a spherical contour and wherein an inlet of the body of the sprayer is received within the barrel section and the flange section is received within the fluid passage of the manifold body and the spherical contour is configured to create a sealing interface with the manifold.

Another aspect of the present disclosure relates to a dishwasher for treating dishes according to a cycle of operation, the dishwasher comprising a tub at least partially defining a treating chamber, a manifold operably coupled to the tub and having a manifold body with an outside surface and an inside surface forming a fluid passage, an opening extends through the outside surface to the fluid passage, a bushing having a barrel section at least a portion of which includes a spherical contour and wherein the spherical contour is configured to abut the opening in the manifold, and a tube sprayer having an inlet at a first end with the first end located within the barrel section of the bushing and operably coupled and the tube sprayer having multiple nozzles collectively forming an outlet, and configured to be rotatable with the bushing about a centered axis of rotation within the opening in the manifold, wherein the spherical contour is further configured to enable continued rotation of the bushing and the tube sprayer along an axis of rotation different from the centered axis of rotation.

DETAILED DESCRIPTION

Figure 1:
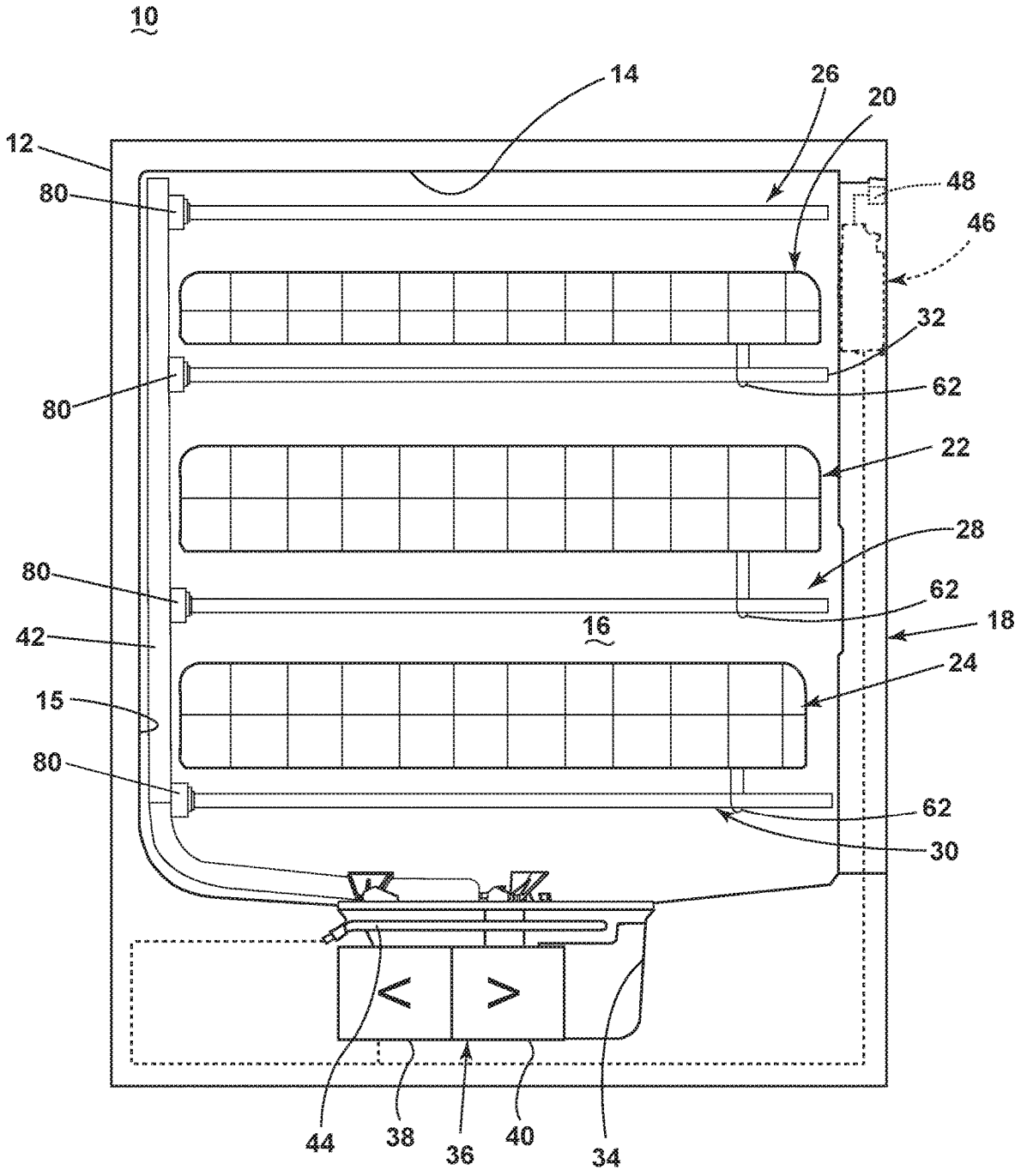
FIG. 1 illustrates a schematic, cross-sectional view of a dishwasher with a spraying system according to an aspect of the resent disclosure.

FIG. 1 illustrates a schematic, cross-sectional view of an exemplary automated dishwasher 10 according to an embodiment of the invention. The dishwasher 10 shares many features of a conventional automated dishwasher, which will not be described in detail herein except as necessary for a complete understanding of the invention. A chassis 12 can define an interior of the dishwasher 10 and can include a frame, with or without panels mounted to the frame. For built-in dishwashers, outer panels are typically not needed. For dishwashers that are not built into existing cabinetry, the chassis 12 can include the panels mounted to the frame to form a cabinet for the dishwasher 10. An open-faced tub 14 can be provided within the chassis 12 and can at least partially define a treating chamber 16 for washing or otherwise treating dishes. The open face of the tub 14 defines an access opening for the treating chamber 16.

A closure element, such as a door assembly 18, can be movably mounted to the dishwasher 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the invention.

Dish holders, illustrated in the form of upper, middle, and lower dish racks 20, 22, 24, can be located within the treating chamber 16 and receive dishes for treatment, such as washing. The upper, middle, and lower racks 20, 22, 24 are typically mounted for slidable movement in and out of the treating chamber 16 for ease of loading and unloading. Other dish holders can be provided, such as a silverware basket, separate from or integral with any of the upper, middle, and lower racks 20, 22, 24. As used in this description, the term "dish(es)" is intended to be generic to any item, single or plural, that may be treated in the dishwasher 10, including, without limitation, dishes, plates, pots, bowls, pans, glassware, and silverware. While the dishwasher 10 is illustrated herein as having three dish racks 20, 22, 24, it will be understood that any suitable number and configuration of dish racks is also within the scope of the invention.

A spray system can be provided for spraying liquid in the treating chamber 16 and can be provided, for example, in the form of rotatable sprayers, illustrated herein as an upper rotatable sprayer 26, an upper middle rotatable sprayer 32, a lower middle rotatable sprayer 28, and a lower rotatable sprayer 30. The upper rotatable sprayer 26, the upper middle rotatable sprayer 32, and the lower middle rotatable sprayer 28 are located, respectively, above the upper rack assembly 20, above the middle rack assembly 22, and above the lower rack assembly 24. The lower rotatable sprayer 30 is located beneath the lower rack assembly 24. By example, the illustrated rotatable sprayers 26, 28, 30, 32 are adapted to mate or dock with a manifold 80. The manifold 80 can be mounted one a rear wall 15 of the tub 14, such as to a liquid supply conduit 42, or in any other suitable location.

It will be further understood that the rotatable sprayers 26, 28, 30, 32, while illustrated as being positioned beneath a central region of the dish racks 20, 22, 24, can also be provided adjacent the opposing walls of the tub 14. Further, at least two of the rotatable sprayers 26, 28, 30, 32 can be adjacent different ones of the at least two opposing walls of the tub 14, even being provided in such a configuration that the at least two rotatable sprayers 26, 28, 30, 32 are provided adjacent opposing side walls as well as adjacent to the bottom of the same dish rack 20, 22, 24. It will also be understood that each of the levels of rotatable sprayers 26, 28, 30, 32 can comprise multiple rotatable sprayers 26, 28, 30, 32 provided in parallel with one another and spread out horizontally across the width of the manifold 80, which can extend generally from one side wall to another side wall of the tub 14.

A recirculation system can be provided for recirculating liquid from the treating chamber 16 to the spray system. The recirculation system can include a sump 34 and a pump assembly 36. The sump 34 collects the liquid sprayed in the treating chamber 16 and can be formed by a sloped or recess portion of a bottom wall of the tub 14. The pump assembly 36 can include both a drain pump 38 and a recirculation pump 40. The drain pump 38 can draw liquid from the sump 34 and pump the liquid out of the dishwasher 10 to a household drain line (not shown). The recirculation pump 40 can draw liquid from the sump 34, and the liquid can be simultaneously or selectively pumped through a liquid supply conduit 42, into the manifold 80, and then distributed to each of the rotatable sprayers 26, 28, 30, 32 for selective spraying. The liquid supply conduit 42 and manifold 80 extend along a wall of the tub 14 and fluidly connect the pump assembly 36 to the at least one rotatable sprayer 26, 28, 30, 32.

While not shown, a liquid supply system can include a water supply conduit coupled with a household water supply for supplying water to the treating chamber 16. A heating system including a heater 44 can be located, for example, within the sump 34 for heating the liquid contained in the sump 34.

A control system including a controller 46 can also be included in the dishwasher 10, which can be operably coupled with various components of the dishwasher 10 to implement a cycle of operation. The controller 46 can be located within the door assembly 18 as illustrated, or it can alternatively be located somewhere within the chassis 12. The controller 46 can also be operably coupled with a control panel or user interface 48 for receiving user-selected inputs and communicating information to the user. The user interface 48 can include operational controls such as dials, lights, switches, and displays enabling a user to input commands, such as a cycle of operation, to the controller 46 and receive information.

Figure 2:
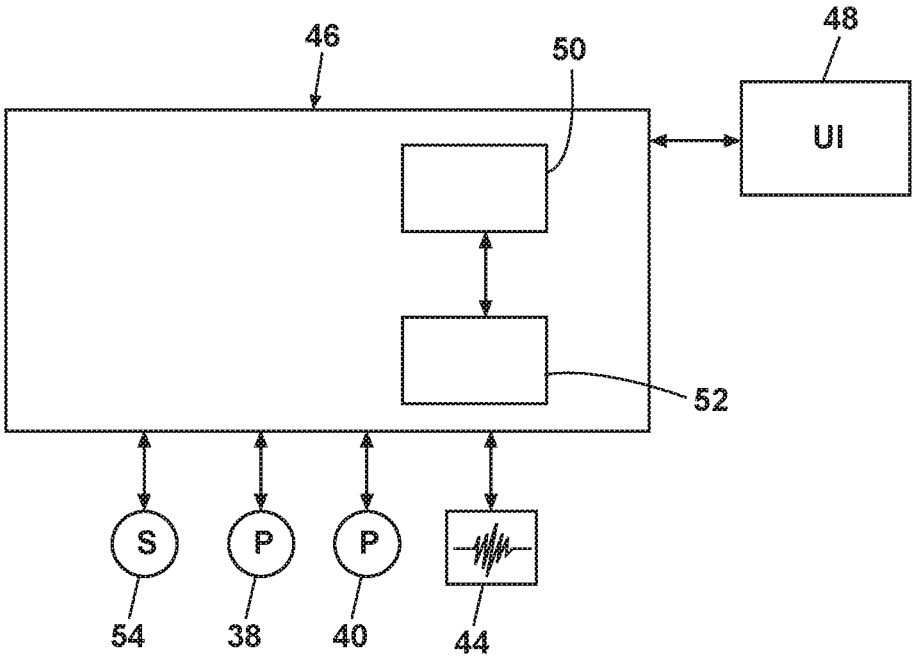
FIG. 2 illustrates a schematic view of a control system for the dishwasher of FIG. 1.

As illustrated schematically in FIG. 2, the controller 46 can be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 can be provided with a memory 50 and a central processing unit (CPU) 52. The memory 50 can be used for storing control software that can be executed by the CPU 52 in completing a cycle of operation using the dishwasher 10 and any additional software. For example, the memory 50 can store one or more pre-programmed cycles of operation that can be selected by a user and completed by the dishwasher 10. The controller 46 can also receive input from one or more sensors 54. Non-limiting examples of sensors that can be communicably coupled with the controller 46 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher can further include are a dispensing system that supplies one or more treating agents or chemistries to the treating chamber 16 and an air supply system that may provide air, which can be heated or not heated, to the treating chamber 16, such as for drying and/or cooling the dishes. An exemplary air supply system is set forth in U.S. patent application Ser. No. 12/959,673, filed Dec. 3, 2010, and published as U.S. Patent Application Publication No. 2012/0138106 on Jun. 7, 2012, both of which are incorporated herein by reference in their entireties.

Figure 3:
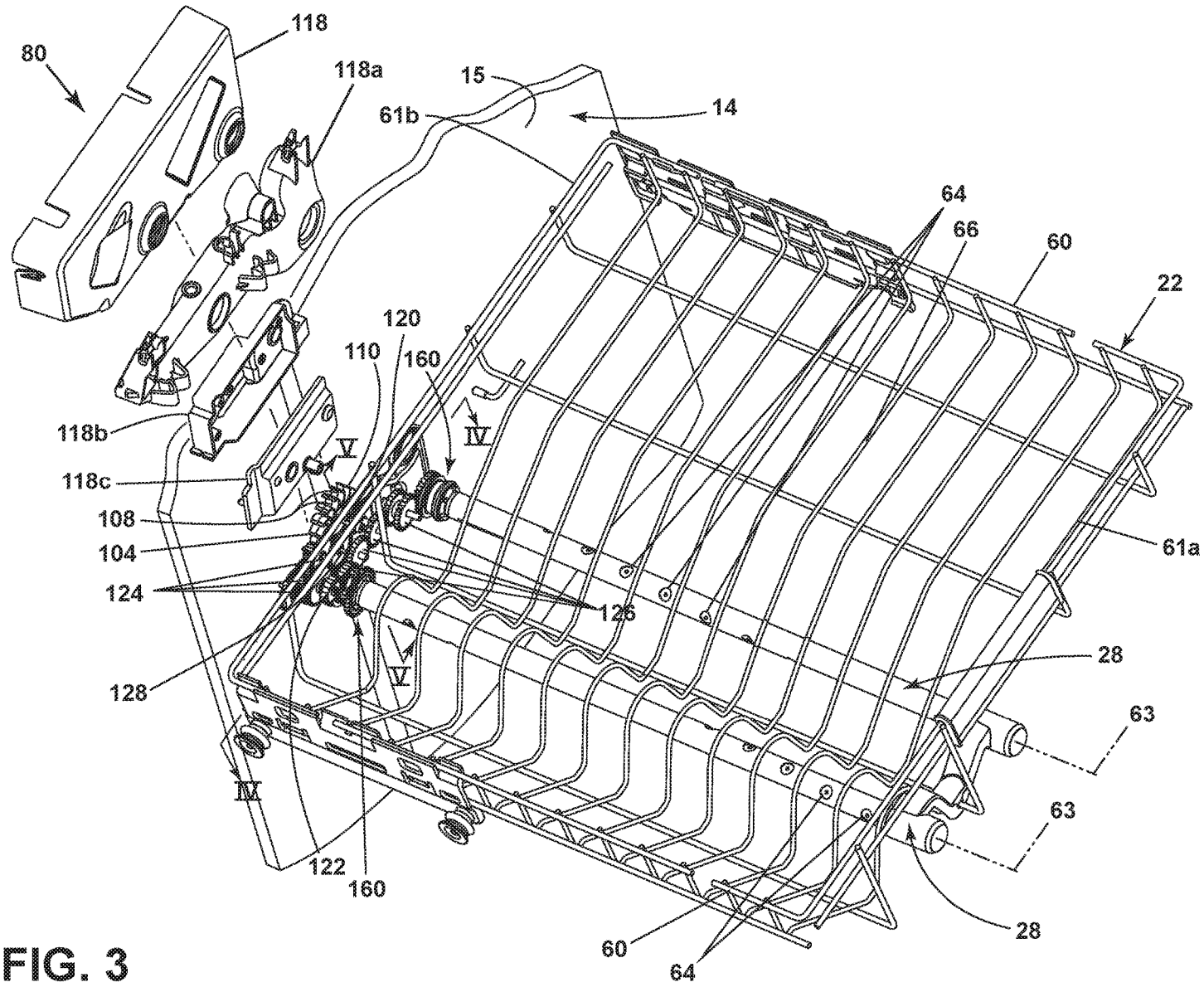
FIG. 3 illustrates a perspective view of a portion of the liquid spray assembly of the dishwasher of FIG. 1.

FIG. 3, illustrates an exemplary dish rack 22 and set of rotatable sprayers 28 therefore. The dish rack 22 can be constructed of a wire frame forming opposing side walls 60, front wall 61*a* and rear wall 61*b* and a bottom wall 66 that together define an open-top holding compartment 68. The bottom wall 66 can be completely flat or it can have a varied configuration comprising any combination of inclined, curved, or flat sections or plurality of sections. The varying profile can be utilized to support various dishes. Additionally or alternatively, a plurality of supports such as panels, tines, or other structures, can extend upwardly from the bottom wall 66 and/or the side walls 60, or the front and rear walls to support various dish items.

The dish rack 22 can be equipped with the set of rotatable sprayers 28 adapted to provide treating liquid to dish items placed on the dish rack 22. Each of the set of rotatable sprayers 28 can be selectively rotatable about an axis of rotation 63. In an exemplary embodiment, the rotatable sprayer 28 includes a body in the form of a rod that has a longitudinal axis, which is the axis about which the rotatable sprayer 28 is selectively rotatable.

Rotation of the rotatable sprayer 28 can be driven by a single drive mechanism that is coupled directly to the rotatable sprayer 28.

It will also be understood that rotations of a plurality of rotatable sprayers 26, 28, 30, 32 can be driven concurrently by a single unified drive mechanism that can control the rotation of multiple rotatable sprayers 26, 28, 30, 32 by the use of, for example, a series of gears that connects the rotatable sprayers 26, 28, 30, 32 and drives them all to rotate in parallel. The mechanism or actuator for driving the rotation of the rotatable sprayers 26, 28, 30, 32, either in series or individually, can be any suitable driving mechanism, non-limiting examples of which include an electric or hydraulic motor selectively operable to directly drive rotation of one or more rotatable sprayers 26, 28, 30, 32 or a gear assembly, which could be provided in the form of a worm gear assembly, spur gears, etc.

The dish rack 22 can be provided with an attachment mechanism 62 (See FIG. 1) that extends downwardly from the bottom wall 66 of the dish rack 22 to attach to and support the rotatable sprayer 28. The attachment mechanism 62 can be any suitable shape that provides support for the front end of the rotatable sprayer 28 and allows for selective rotation of the rotatable sprayer 28. Non-limiting examples of such an attachment mechanism include a hook, a hanger, a bracket, etc.

Figure 6:
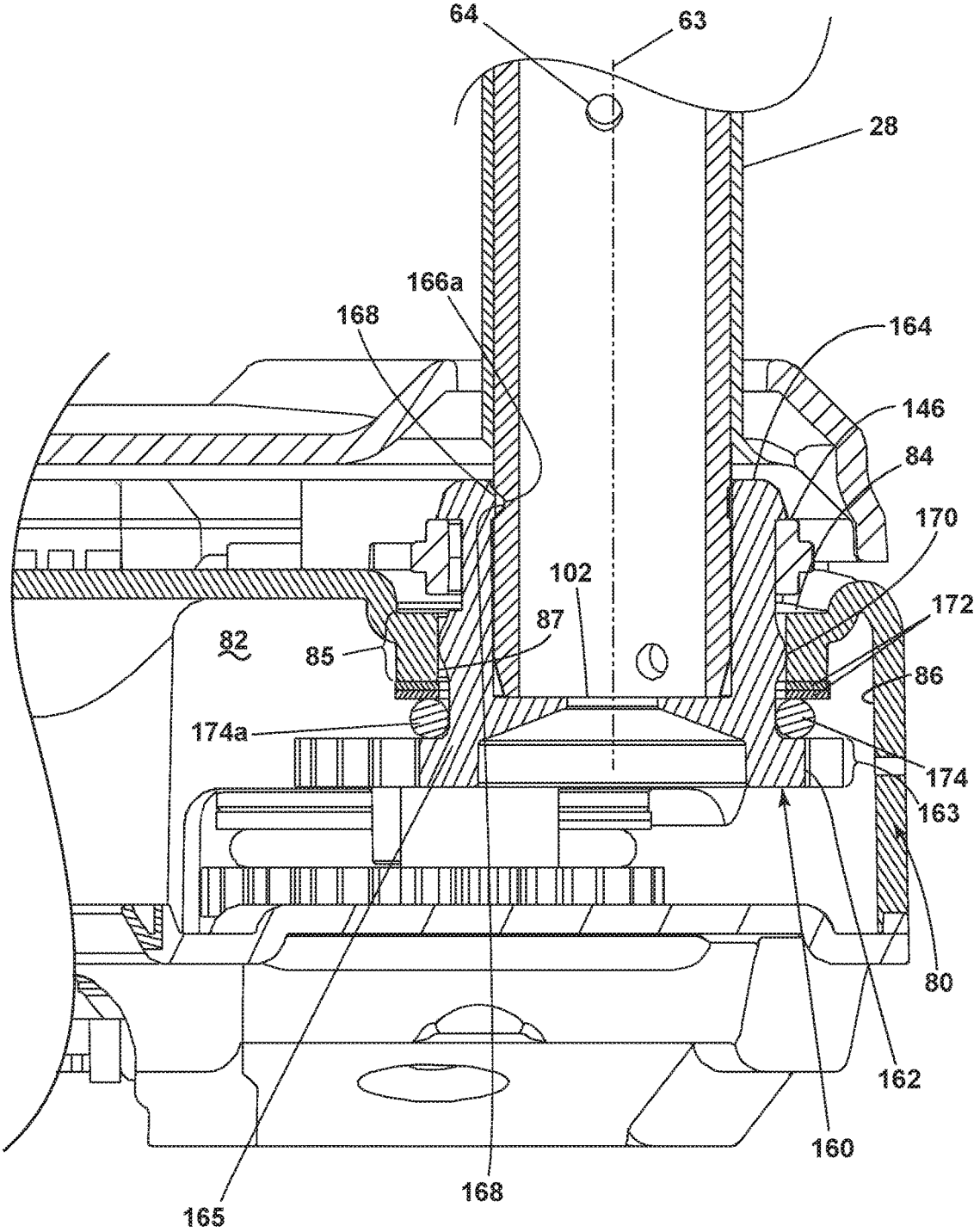
FIG. 6 illustrates another cross-sectional view of a portion of the liquid spray assembly illustrated in FIG. 3.

The rotatable sprayer 28 can be fixedly mounted to the dish rack 22 by the attachment mechanism 62 for movement therewith when the dish rack 22 is slid relative to the tub 14, or the rotatable sprayer 28 can be fixedly mounted to the manifold 80 so as to retain its position relative to the manifold 80 upon movement of the dish rack 20. In the former case, the rotatable sprayer 28 can dock with the manifold 80, when the dish rack 22 is slid to its most rearward position in the tub 14 to establish fluid communication with the liquid supply and/or recirculation systems. By way of non-limiting example, the manifold 80 can be adapted to selectively mate or dock with the liquid supply conduit 42. The manifold 80 can include a body formed from, among other things, a number of housing portions 118, 118*a*, 118*b*, and 118*c*, to from one or more fluid passage 82 (FIG. 6).

Figure 4:
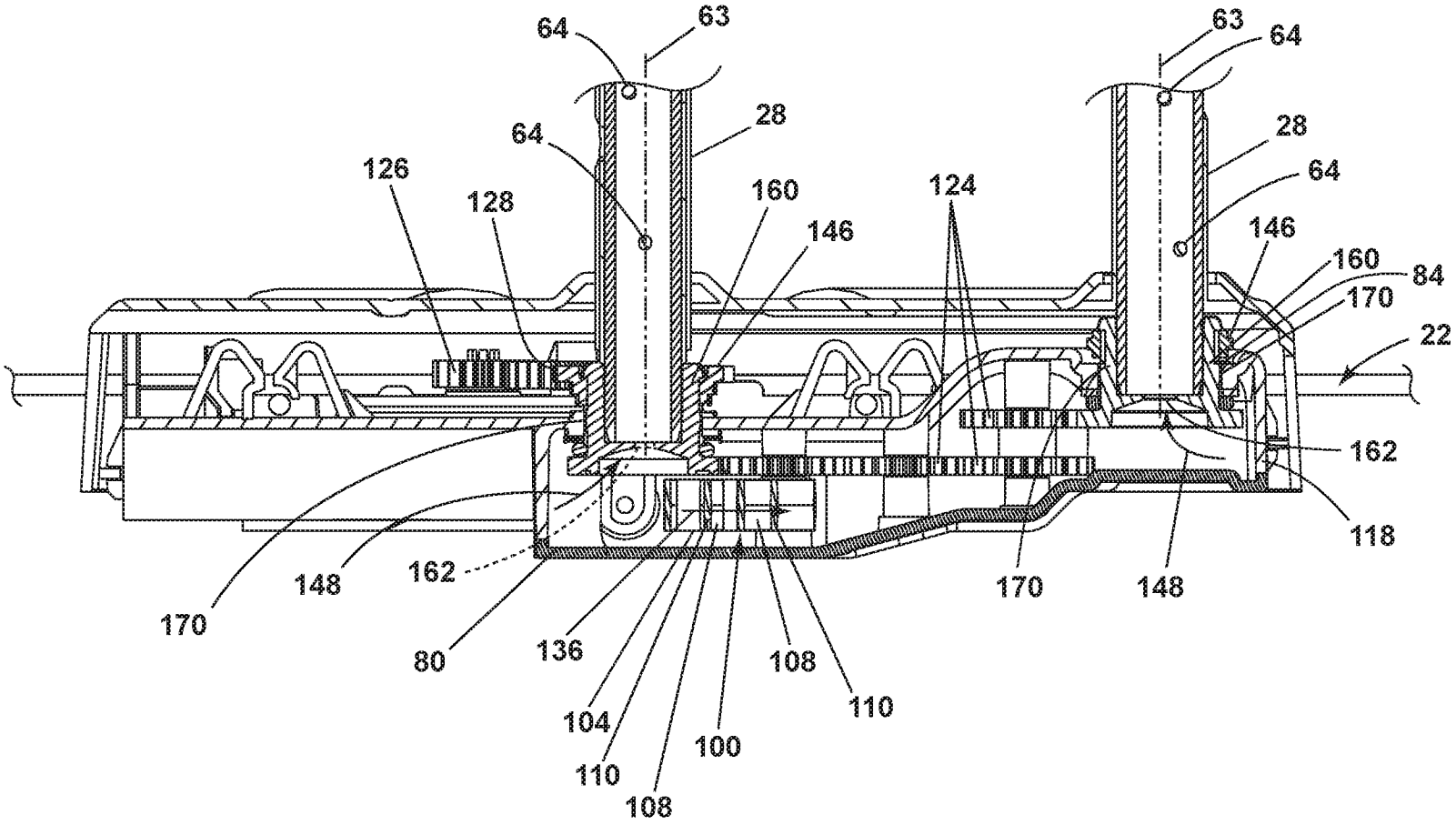
FIG. 4 illustrates a cross-sectional view of a portion of the liquid spray assembly illustrated in FIG. 3.

The rotatable sprayer 28 has been illustrated in the form of a rod or tube sprayer. FIG. 4 more clearly illustrates that the rotatable sprayer includes an inlet 102 at a first end of the rotatable sprayer 28. A plurality of spray nozzles 64 that collectively form an outlet of the rotatable sprayer 28 can also be included along at least a portion of a length of the tube. The spray nozzles 64 can be positioned to spray treating liquid onto the dish items contained within the holding compartment 68 of the dish rack 22. The spray nozzles 64 can be provided along the length of the rotatable sprayer 28 in any suitable configuration, which can be linear or non-linear. By rotating the rotatable sprayer 28, treating liquid can be sprayed in multiple spray angles and trajectories from a single one of the plurality of spray nozzles 64. The nozzles 64 can be provided on the surface of the rotatable sprayer 28, or they can be indented or recessed into the surface of the rotatable sprayer 28. The volume and velocity of the treating liquid emitted from the spray nozzles 64 can be based on the type of dish item contained within the dish rack 22, can be generic for all types of dish items, and/or can be variable from one treating cycle of operation to another and/or within a single treating cycle of operation. Additionally, the spray nozzles 64 can spray liquid alternately (e.g., between rows—one row at a time wherein the rows are sequenced on and off, within rows—sets of nozzles 64 within a row sequenced on and off), continuously, and/or intermittently.

FIG. 4 also illustrates that a hydraulic drive 100 can be included within the manifold 80 and can be configured to affect the rotation of the rotatable sprayer 28. The hydraulic drive 100 can also be configured to fluidly couple the liquid supply conduit 42 (FIG. 1) to the inlet 102 of the rotatable sprayer 28 via the fluid passage 82 within the manifold 80. More specifically, the hydraulic drive 100 comprises a rotatable turbine 104 that is mechanically coupled to the rotatable sprayer 28 such that liquid supplied from the liquid supply conduit 42 via the manifold 80 rotates the rotatable turbine 104 to affect the rotation of the rotatable sprayer 28. In an exemplary embodiment, the rotatable turbine 104 can be an impulse turbine. It will be understood that a different type of rotatable turbine 104 could also be suitably employed within the hydraulic drive 100, non-limiting examples of which include a reaction turbine, Archimedes turbine, or any other suitable paddle wheel shape.

The rotatable turbine 104 includes a plurality of circumferentially spaced buckets 108, which are at least partially defined by a plurality of curved vanes 110. The buckets 108 are positioned radially outward of and circumferentially surrounding a runner. The buckets 108 have a curved bottom and no sides, such that fluid is able to flow freely out of the buckets 108 to the sides. The rotatable turbine 104 can be operably coupled to a drive shaft 120, drive gear 122, which can in turn operate any number of gear trains 124 and 136 to rotate any number of components including the rotatable sprayer(s) 28. An exemplary turbine and gear train is set forth in U.S. patent application Ser. No. 15/075,552, filed Mar. 21, 2016, which is incorporated herein by reference in its entirety. The quantity of vanes 110 and buckets 108 that make up the rotatable turbine 104 can be any number that is suitable to the mechanical constraints and performance requirements of the hydraulic drive 100. The diameter of the rotatable turbine 104 can be any suitable size that is within the spatial limits of the system clearance of the dishwasher 10.

By way of non-limiting example, a drive gear 122 can be further operably coupled to a gear train 124 that serves to couple the rotatable turbine 104 to the rotatable sprayer 28. In an exemplary embodiment, the gear train 124 is a gear reducing gear train 124 comprising a plurality of reduction gears. The reduction gears can be any suitable type of gears that allow for efficient energy transfer, including, but not limited to, compound spur gears. The teeth of the reduction gears can be undercut to allow for a spacing tolerance between adjacent reduction gears. The gear train 124 can be further operably coupled to an output gear 128, which is operably coupled with a toothed ring 146 (better seen in FIG. 6) that is provided about a bushing 160 retaining an end portion of the rotatable sprayer 28 in order to affect the rotation of the rotatable sprayer 28. The output gear 128 or the toothed gear 146 of one of the rotatable sprayers may also drive a second gear train 126 operably couple to a toothed gear or another of a bushing 160 on a second of the set of the rotatable sprayers 28. It will be understood that any suitable shape sprayer could be utilized instead of a tube and that in such an instance an intermediate coupling piece may be included with the bushing.

It will be understood that a number of separate or integral housing portions 118 can be included as portions of the manifold 80 or attached to the manifold 80. Any number of shafts, bushings, or toothed gears may extend through such housings to allow the hydraulic drive 100 to operate to contain the liquid within the fluid passage created by the manifold to transfer the liquid to the rotatable sprayer(s) 28. The housing portion 118*b* and housing portion 118*c* can be combined to be collectively thought of as a single unit housing, which can be a gear box structure. In the exemplary embodiment illustrated herein, the rotatable turbine 104 is located outside of the gearbox although this need not be the case.

During operation of the hydraulic drive 100, wash liquid is supplied to the rotatable sprayer(s) 28 from the liquid supply conduit 42 via the manifold 80, along a flow path indicated by the arrow 148. As the wash liquid flows through the manifold 80 toward the rotatable sprayer(s) 28, a portion of the wash liquid flows in an alternate flow path, through a nozzle (not shown) and over the rotatable turbine 104. The wash liquid can be allowed to flow freely over the rotatable turbine 104 from the manifold 80, or it can flow through at least one nozzle (not shown) that serves to emit the wash liquid directly onto the rotatable turbine 104, and, more specifically, onto the buckets 108 of the rotatable turbine 104. The nozzle (not shown) can have an inlet fluidly coupled to the manifold 80 and an outlet oriented to direct a spray of wash liquid onto the rotatable turbine 104. The force from the wash liquid being emitted onto the rotatable turbine 104 causes the rotatable turbine 104 to rotate.

As the rotatable turbine 104 rotates, the drive shaft 120 and, in turn, the drive gear 122 also rotate at the same rate of rotation as the rotatable turbine 104. The drive gear 122 then transfers the energy and motion from the rotatable turbine 104 to the gear train 124 which comprises a plurality of reduction gears. As the rotation from the rotatable turbine 104 travels through the gear train 124, the rate of rotation of the reduction gears becomes reduced relative to the rate of rotation of the rotatable turbine 104. The reduction gears are further operably coupled to transfer rotation to the output gear 128. The output gear 128 then transfers rotation to the rotatable sprayer 28 by way of the mechanical coupling of the toothed outer portion 140 of the output gear 128 with the toothed ring 146 that is provided about the bushing 160. The operable coupling of the output gear 128 with the bushing 160 and thus the rotatable sprayer 28 allows rotation of the rotatable sprayer 28 to be affected via the mechanical coupling with the rotatable turbine 104.

The final rate of rotation at the rotatable sprayer(s) 28 can be, by non-limiting example, between the range of 1 and 10 revolutions per minute, which is reduced from the rotational speed of the rotatable turbine 104. It is contemplated herein that there could be provided a hydraulic drive 100 coupled with each rotatable sprayer 26, 28, 30, 32 within the dishwasher 10. It will be further understood that there can also be fewer hydraulic drives 100 than rotatable sprayers 26, 28, 30, 32, including only a single hydraulic drive 100. In the case that there are fewer hydraulic drives 100 than rotatable sprayers 26, 28, 30, 32, an additional series of gears can be provided within the manifold 80 of the dishwasher 10 that serves to couple more than one rotatable sprayer 26, 28, 30, 32 to a single hydraulic drive 100.

Referring now to the operational fluid coupling of the liquid supply conduit 42 to the rotatable sprayer 28, wash liquid flows through the liquid supply conduit 42 to the manifold 80 and eventually at least a portion of the wash liquid flows over the rotatable turbine 104 in the direction indicated by water flow arrow 132. The flow of the wash liquid over the turbine 104 in the direction of the water flow arrow 132 causes the rotation of the rotatable turbine 104 in a same direction as indicated by the flow arrow 132. As the wash liquid flows over the rotatable turbine 104 in the direction of the water flow arrow 132, the wash liquid will then flow out of the rotatable turbine 104 as the rotatable turbine 104 completes a rotation. The wash liquid flowing off of the rotatable turbine 104 is directed into the treating chamber 16 of the tub 14 for recirculation.

The portion of the wash liquid that does not exit the manifold 80 to flow over the rotatable turbine 104 will continue to flow through the manifold 80 along the flow paths indicated by the arrows 148. The flow path indicated by the arrows 148 within the manifold 80 are fluidly coupled to the inlets 102 of the rotatable sprayers 28. In this way, a portion of the wash liquid flows over the rotatable turbine 104 to cause rotation of the rotatable turbine 104, and, in turn, rotation of the rotatable sprayer 28 by way of the gearbox, while the remaining portion of the wash liquid within the manifold 80 flows into the rotatable sprayer 28 to be expelled from the nozzles 64 and be used to wash the dishes within the dishwasher 10.

As described above, in hydraulically driven rotatable systems the water pressure within the liquid spray system can be utilized to drive the rotatable sprayer(s) 26, 28, 30, 32 and provide pressurized spray(s) to clean the dish(es). In simple terms, the less torque that is needed by the system to rotate the sprayer(s) the more pressure that is available to spray the dishes. One problem that can be encountered by the liquid spray system is that the tube forming the rotatable sprayer(S) 28 can be bowed, loaded, moved, or have at least a portion otherwise offset from its typical axis of rotation 63, which is usually aligned with the same center line of the bushing 160. When this occurs the bushing 160 can bind with the manifold 80. When this occurs the rotation of the rotatable sprayer 28 can stall or additional torque can be necessary to keep the rotatable sprayer 28 rotating.

Figure 5:
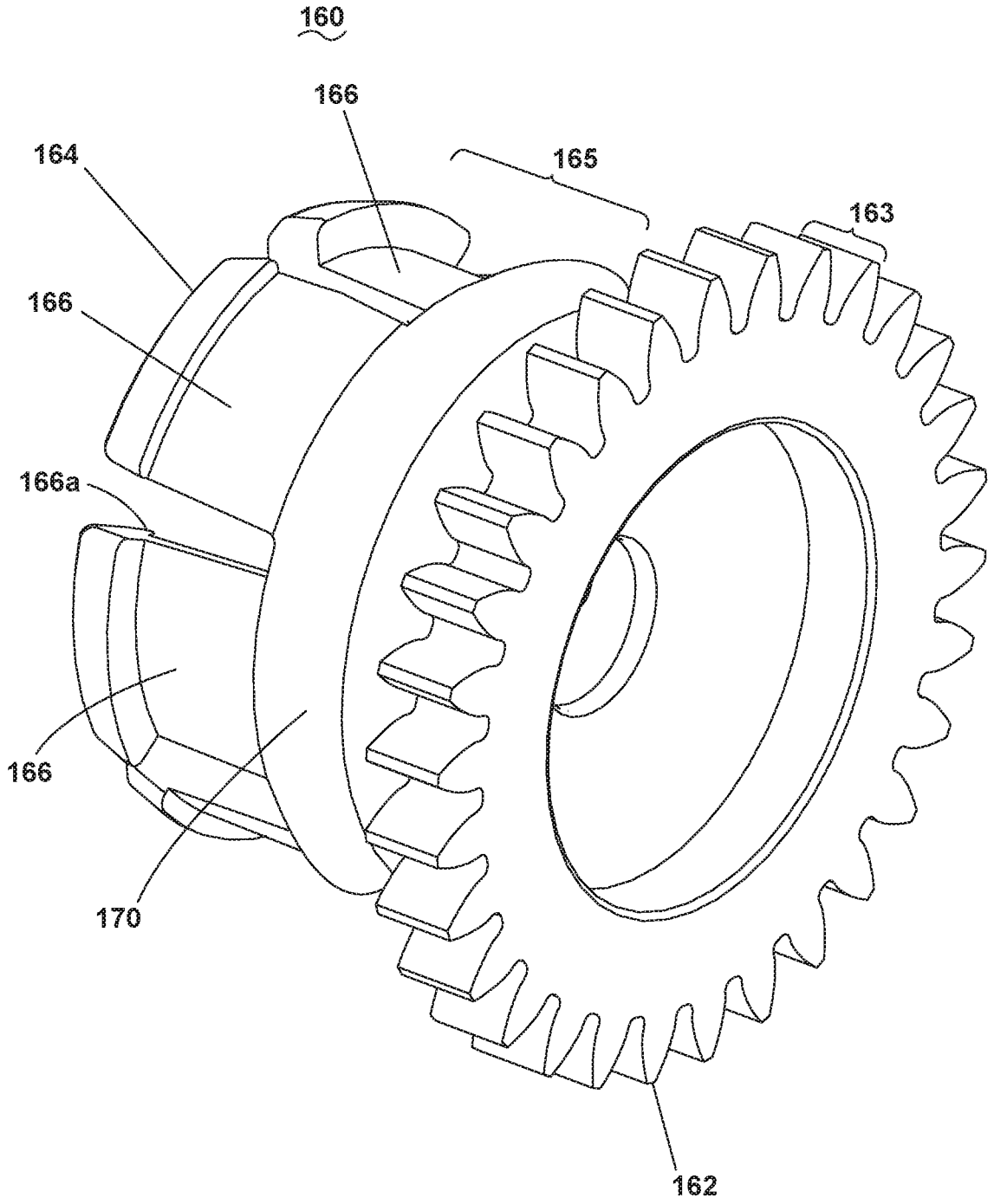
FIG. 5 illustrates a perspective view of a bushing of the liquid spray assembly of FIG. 4

Aspects of the disclosure include a bushing that reduces friction, binding, and drag while still providing sealing between the manifold 80 and rotatable sprayer 28. More specifically, FIG. 5 illustrates a perspective view of the bushing 160 having a first end 162 defined by a flange section 163, a second end 164, and a barrel section 165 that includes a spherical section 170. The flange section can include teeth that may act to receive and transfer torque to other portions of the gear trains as described above. A remainder of barrel section 165 is cylindrical. A set of fingers 166 extend from the barrel section 165 and define the second end 164. At least some of the set of fingers 166 can include a protrusion **166*a* or other fastening feature to add in mechanically coupling to the rotatable sprayer 28**.

As illustrated more clearly in FIG. 6, the manifold 80 includes a manifold body with an outside surface 84 and an inside surface 86 forming the fluid passage 82. An opening 87 extends through the outside surface 84 to the fluid passage 82. The opening 87 is formed by a wall 85 extending from the outside surface 84 into the fluid passage 82. The opening 87 is recessed from the outside surface 84 of the manifold 80. A set of washers 172 and a gasket 174, such as by way of non-limiting example an o-ring can be located between the flange section 163 and the wall 85.

Figure 7:
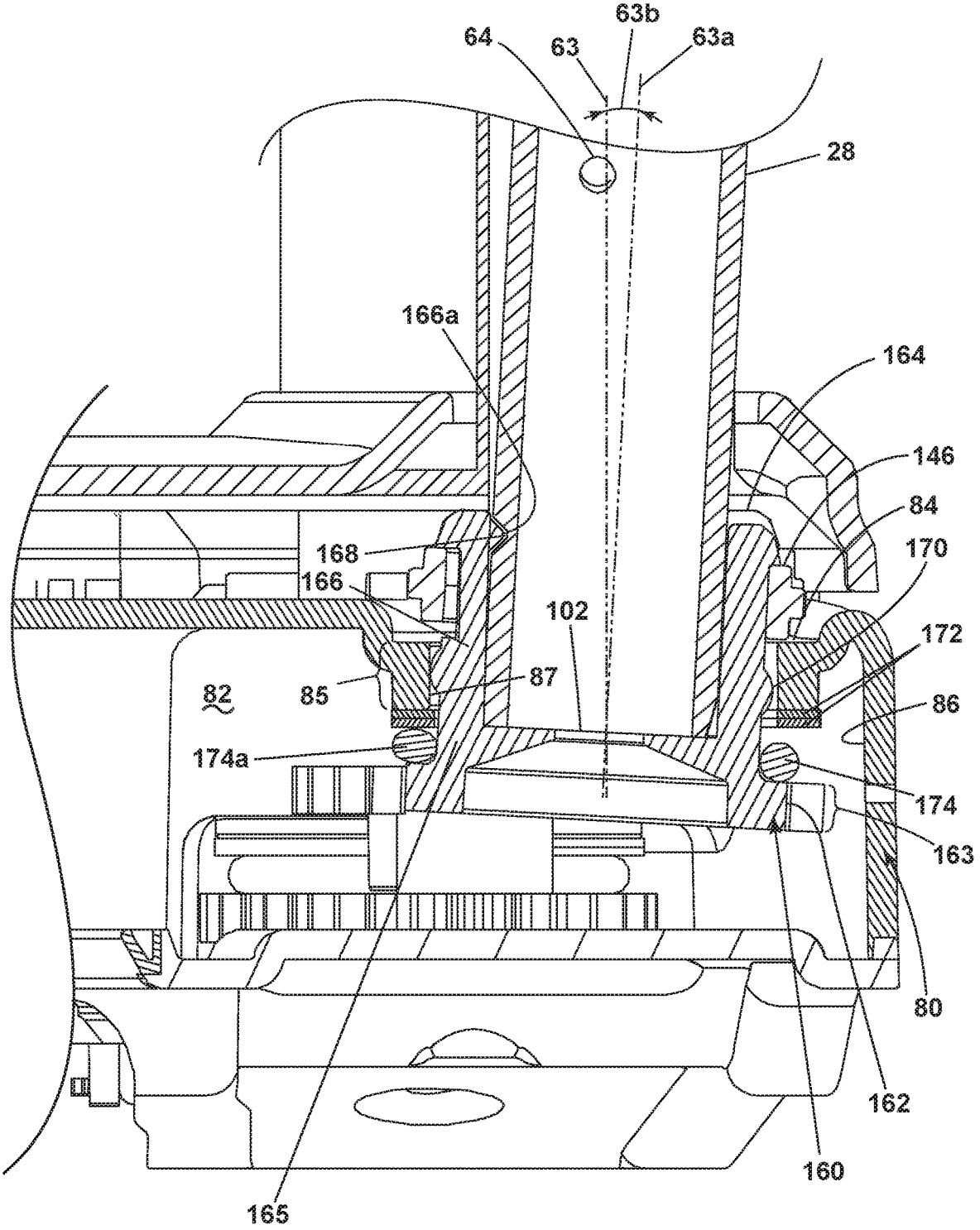
FIG. 7 illustrates a rotatable sprayer and bushing of FIG. 6 in second positions.

The barrel section 165 is located about the inlet 102 of the rotatable sprayer 28. The tube body of the rotatable sprayer 28 can include a channel 128 or other catch to retain the protrusions **166*a* on the set of fingers 166. The barrel section 165 is located within the opening 87 such that the bushing 160 is rotatable therein. The spherical section 170 abuts the wall 85 and acts to for a sealing interface that creates a fluid tight seal or at the very least forms a tortious path for water to find its way from the fluid passage 82 into the tub 14. When the liquid spray system is pressurized with liquid the spherical section 170 will be pushed against the wall 85. This creates a good seal. Further, the bushing 160 can pivot as shown in FIG. 7 such that its rotational axis is now at another axis 63*am* which is angled 63*b* from the original center of the opening 87. The spherical section 170** is configured to continue with creating this sealing interface while the bushing is pivoted.

When the bushing 160 is pivoted a portion of the gasket 174 can be compressed and a portion of the gear 164 can be brought closer to the manifold 80. The recessing of the opening 87 from the outside surface 84 by a predetermined gap, such as 0.6 mm, ensures that when the bushing 160 is pivoted no contact occurs between the components. Minimizing the touching surface area of the components in turn minimizes the friction and drag. This in turn does not put increases torque demands on the system. The aspects of the disclosure allow for the bushing to move to a greater angle without binding and this allows the components to achieve a larger angle and maintain a tight gap to the manifold to creating a better sealing interface or more torturous path.

In a traditional dishwasher, spray assemblies can be a significant contributor to space constraints. Using a rotatable sprayer in the form of a spray tube rather than a spray arm reduces the height of the spray assemblies and allows for more usable space in the dish racks. However, the drive system for the rotating spray tubes can be a significant contributor to cost and complexity of the dishwasher. Aspects of the present disclosure provide similar or improved performance to contemporary appliances by using the wash liquid itself to drive the rotation of the rotatable sprayers, eliminating the need for an electric motor or other actuator. The hydraulic drive described herein allows for compression of the water delivery device while exhibiting maximal efficiency. The invention of the present disclosure is also modular, allowing it to be placed on any tube wash manifold inside a dishwasher, or, even further, on any wash system component that needs to rotate.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to a cycle of operation, the dishwasher comprising:

a tub at least partially defining a treating chamber;

a manifold operably coupled to the tub and having a manifold body forming a fluid passage;

a sprayer having a sprayer body, a portion of which is rotatably housed within the manifold, the sprayer body defining an inlet, multiple nozzles collectively forming an outlet, and rotatable about an axis of rotation; and a bushing including a flange section defining a first end and a barrel section at least a portion of which includes a spherical contour defining a spherical contour portion and wherein the inlet of the sprayer body is received within the barrel section and the flange section is received within the fluid passage of the manifold body and the spherical contour portion is configured to create a sealing interface with the manifold.

2. The dishwasher of claim 1 wherein the sprayer body is defined at least in part by a rod having a longitudinal axis.

3. The dishwasher of claim 2 wherein the inlet of the sprayer is located at a first end of the rod.

4. The dishwasher of claim 3 wherein the multiple nozzles are spaced along at least a portion of a length of the rod.

5. The dishwasher of claim 3 wherein the manifold body includes an opening recessed within a surface of the manifold.

6. The dishwasher of claim 5 wherein the spherical contour portion is configured to create a sealing interface with the opening.

7. The dishwasher of claim 2 wherein the longitudinal axis is the rotation axis.

8. The dishwasher of claim 1 wherein the barrel section further comprises a set of resilient fingers each having a protrusion received within a channel of the sprayer body.

9. The dishwasher of claim 8, further comprising a gear located about the set of resilient fingers and wherein the gear is spaced from a surface of the manifold by a predetermined gap.

10. The dishwasher of claim 9 wherein the predetermined gap is 0.6 mm.

11. The dishwasher of claim 1, further comprising, a hydraulic drive fluidly coupling an inlet of the manifold to the sprayer and mechanically coupled to the sprayer such that liquid supplied from the inlet of the manifold through the hydraulic drive causes rotation of the sprayer.

12. The dishwasher of claim 11 wherein the hydraulic drive comprises a rotatable turbine mechanically coupled to the sprayer wherein liquid supplied from the fluid passage rotates the rotatable turbine and causes the rotation of the sprayer.

13. The dishwasher of claim 12, further comprising a gear train coupling the rotatable turbine to the sprayer.

14. The dishwasher of claim 13 wherein at least one of the rotatable turbine and gear train are located within the manifold.

15. The dishwasher of claim 1, further comprising a gasket located between the manifold and the flange section.

16. A dishwasher for treating dishes according to a cycle of operation, the dishwasher comprising:

a tub at least partially defining a treating chamber;

a manifold operably coupled to the tub and having a manifold body with an outside surface and an inside surface forming a fluid passage, an opening extends through the outside surface to the fluid passage;

a bushing having a barrel section at least a portion of which includes a spherical protrusion that defines a spherical contour portion and wherein the spherical contour portion is configured to abut the opening in the manifold; and a tube sprayer having an inlet at a first end with the first end located within the barrel section of the bushing and operably coupled and the tube sprayer having multiple nozzles collectively forming an outlet, and configured to be rotatable with the bushing about a centered axis of rotation within the opening in the manifold;

wherein the spherical contour portion is further configured to enable continued rotation of the bushing and the tube sprayer along an axis of rotation different from the centered axis of rotation.

17. The dishwasher of claim 16 wherein the opening is formed by a wall extending from the outside surface into the fluid passage.

18. The dishwasher of claim 17 wherein the spherical contour portion creates a sealing interface with the wall.

19. The dishwasher of claim 17, further comprising a gasket located between the wall and an end of the bushing.

20. The dishwasher of claim 16, further comprising, a hydraulic drive fluidly coupling an inlet of the manifold to the tube sprayer and mechanically coupled to the tube sprayer such that liquid supplied from the inlet of the manifold through the hydraulic drive causes rotation of the tube sprayer.

* * * * *